US006093305A

United States Patent [19]

Hibino

[11] Patent Number: 6,093,305

[45] Date of Patent: Jul. 25, 2000

[54] METHOD OF PRODUCING HYDROGEN HALIDE AND OXYGEN

[75] Inventor: Kouetsu Hibino, Nisshin, Japan

[73] Assignee: Toyota Jidosha Kabushiki Kaisha, Japan

[21] Appl. No.: 09/159,130

[22] Filed: Sep. 23, 1998

[30] Foreign Application Priority Data

Sep. 24, 1997 [JP] Japan ..... 9-258766

[51] Int. Cl.[7] ..... C01B 7/01

[52] U.S. Cl. ..... 205/556; 205/633

[58] Field of Search ..... 205/556, 633, 205/637, 464, 498

[56] References Cited

U.S. PATENT DOCUMENTS 5,709,791 1/1998 Hibino et al. .

FOREIGN PATENT DOCUMENTS 8-301606 11/1996 Japan .

*Primary Examiner*—Arun S. Phasge

*Attorney, Agent, or Firm*—Finnegan, Henderson, Farabow, Garrett & Dunner, L.L.P.

[57] ABSTRACT

The present invention discloses a method of producing hydrogen halide and oxygen by reacting water and halogen as represented by the following formula:

$$H_2O+X_2 \rightarrow HX+\tfrac{1}{2}O_2 \quad (1)$$

(wherein, X represents a halogen), wherein activated carbon is used as catalyst, said activated carbon is inserted into an aqueous solution containing said halogen as an electrode, a counter electrode is inserted into said solution and, after bringing this counter electrode into contact with said active carbon electrode, the above reaction takes place in a reaction system in which said activated carbon electrode and counter electrode are connected outside said aqueous solution. Moreover, a voltage is applied between the activated carbon electrode and counter electrode, and contact between the activated carbon electrode and counter electrode is made through an anion electrolyte membrane. In addition, openings are provided in this anion electrolyte membrane.

6 Claims, 3 Drawing Sheets

METHOD OF PRODUCING HYDROGEN HALIDE AND OXYGEN

BACKGROUND OF THE INVENTION

1. Field of the Invention

The present invention relates to a method of producing hydrogen halide and oxygen and, more particularly, the present invention relates to a method of producing hydrogen halide and oxygen comprising a chemical reaction in which water and halogen are reacted using activated carbon as a catalyst.

2. Description of the Related Art

Because hydrogen and oxygen are attracting attention as clean sources of energy, a method by which water is broken down electrochemically has been established for their production on an industrial scale. However, this method has problems in terms of cost since it requires a large amount of electrical power. In order to solve this problem, a method has been proposed for chemically decomposing water.

Namely, water is reacted with a halogen to form hydrogen halide and oxygen after which the hydrogen halide is electrically decomposed to form hydrogen. According to this method, since oxygen is obtained by a chemical reaction and hydrogen is obtained at a much lower voltage as a result of electrically decomposing hydrogen halide instead of electrically decomposing water directly, it offers the advantage of being able to reduce the amount of electrical energy required.

However, in this type of method, since carbon granules are introduced as a catalyst in the reaction of halogen and water, these carbon granules react with oxygen formed by the reaction in the form of a side reaction resulting in the formation of carbon dioxide. Thus, this method had the problem of low reaction efficiency as a result of the carbon granules being consumed. In order to solve this problem, the inventors of the present previously proposed the use of activated carbon as catalyst in place of carbon granules in the above-mentioned reaction system (Japanese Unexamined Patent Publication No. 8-301606). As a result of using this activated carbon, a reaction, with oxygen in particular, is inhibited by applying a negative potential to the activated carbon, thereby making it possible to increase the reaction efficiency.

Since activated carbon reacts less with oxygen than carbon granules, although reaction efficiency could be improved by using activated carbon as catalyst in the reaction system of water and halogen, activated carbon still reacted to a certain extent with oxygen, thus preventing this reaction from being completely inhibited. Moreover, at the high temperatures at which this reaction between water and halide proceeds easily, oxidation inhibitory effects are low even when a negative potential is applied to the activated carbon, thus making it impossible to adequately inhibit its reaction with oxygen.

SUMMARY OF THE INVENTION

In order to solve the above-mentioned problems, a first invention provides a method of producing hydrogen halide and oxygen by reacting water and a halogen as represented by the formula shown below, wherein activated carbon is used as catalyst, said activated carbon is inserted into an aqueous solution containing said halogen as an electrode, a counter electrode is inserted into said solution, and together with bringing this counter electrode into contact with said active carbon electrode, the following reaction takes place in a reaction system in which said activated carbon electrode and counter electrode are connected outside said aqueous solution:

$$H_2O+X_2 \rightarrow HX+\tfrac{1}{2}O_2 \quad (1)$$

(wherein, X represents a halogen).

In addition, in a second invention, in order to solve the above-mentioned problems, a voltage is applied to said activated carbon electrode and counter electrode in the first invention.

In addition, in a third invention, in order to solve the above-mentioned problems, said activated carbon electrode and counter electrode are in contact through an anion electrolyte membrane.

In addition, in a fourth invention, in order to solve the above-mentioned problems, an opening is provided in said anion electrolyte membrane that connects said activated carbon electrode and counter electrode in the third invention.

In addition, in a fifth invention, in order to solve the above-mentioned problems, said activated carbon electrode and counter electrode are in contact in alternating multiple layers in the first through fourth inventions.

DETAILED DESCRIPTION OF THE PREFERRED EMBODIMENTS

Figure 1:
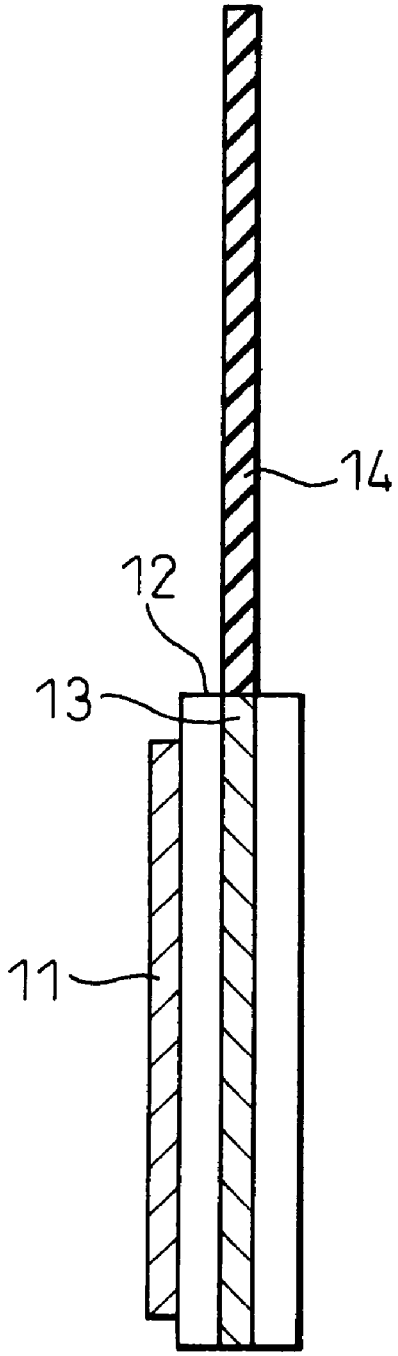
FIG. 1 is a sketch of the structure of an activated carbon electrode used in the present invention.

The method of the present invention is a method of producing hydrogen halide and oxygen by chemically reacting water and halogen and, more specifically, chlorine, bromine and iodine, as represented by the following formula (1):

$$H_2O+X_2 \rightarrow HX+\tfrac{1}{2}O_2 \quad (1)$$

(wherein, X represents a halogen). In this reaction, the reaction does not proceed even after mixing water and halogen because it is necessary to use a catalyst. Conventionally, carbon granules and activated carbon have been used as catalysts. However, in the case of using carbon granules, the carbon is oxidized resulting in the formation of carbon dioxide. As a result, the catalyst is spent which causes the reaction to stop.

As represented by the following formulas:

$$H_2O+X_2 \rightarrow HX+HXO \quad (2)$$

$$HXO \rightarrow HX+\tfrac{1}{2}O_2 \quad (3)$$

in the reaction (1) above, water and halogen first react resulting in the formation of hydrogen halide HX and hypohalogenous acid HXO after which the reaction reaches equilibrium (formula (2)). Moreover, hypohalogenous acid decomposes to halogen hydride and oxygen by a self-decomposition reaction (formula (3)). Thus, the above reaction is believed to proceed in two stages. In the above-mentioned formula (2), the hypohalogenous acid HXO that is formed is a powerful oxidant. Thus, it ends up being oxidized as indicated with the following formula:

$$HXO+C \rightarrow HX+\tfrac{1}{2}CO_2 \quad (4)$$

when carbon granules are added to the reaction system. In addition, although this hypohalogenous acid HXO also results in the separation of oxygen as indicated in the above-mentioned formula (3), carbon granules are believed to be oxidized by this carbon.

Therefore, in order to inhibit this oxidation of carbon granules, the inventors of the present invention previously proposed the use of activated carbon instead of carbon granules as a catalyst in the above-mentioned reaction. Oxidation due to the formed oxygen is considerably inhibited, in particular, by the application of a negative potential to the activated carbon.

The reason for applying a negative potential to this activated carbon is to utilize so-called cathodic protection. This cathodic protection refers to a method of prevention electrode corrosion in which corrosion is prevented by applying cathode current to metal to shift the potential in the negative direction and maintain a potential that is more negative than the equilibrium potential of metal anodic dissolution. Namely, by applying a negative potential to the activated carbon, a potential is applied that is more negative than the equilibrium potential of the oxidation reaction of activated carbon, thereby preventing oxidation.

However, oxidation preventive effects attained by applying this negative potential are only obtained up a temperature of about 60° C., and adequate effects are not obtained at higher temperatures. In contrast, at a temperature of about 60° C., the reaction rate of the reaction according to formula (1) above is insufficient. Thus, means for obtaining oxidation inhibitory effects for activated carbon are required at high temperatures as well.

Therefore, in the present invention, this activated carbon is inserted into an aqueous solution containing halogen in the form of an electrode (cathode). Moreover, a counter electrode (anode) is also inserted so that the activated carbon electrode and counter electrode are in contact. A natural potential occurs between these electrodes and current flows when the activated carbon electrode and counter electrode are connected outside the above-mentioned aqueous solution resulting in the production of gas (oxygen) from the counter electrode.

Since the reactions of formulas (2) and (3) above proceed on the surface of the activated carbon, the resulting HXO and oxygen exist in an ionic state on the activated carbon, which is considered to make the activated carbon susceptible to oxidation. However, in the reaction system of the present invention, since the activated carbon electrode and counter electrode are in contact, the HXO and oxygen ions formed on the surface of the activated carbon (and these carry a negative charge) easily move to the anode in the form of the counter electrode. Oxygen ions and so forth are then reduced on this counter electrode resulting in the production of oxygen. Thus, since ions that oxidize activated carbon remain on the activated carbon unless if the activated carbon electrode and counter electrode are not allowed to come in contact, the activated carbon is oxidized. In this manner, in the reaction system of the present invention, since oxygen ions that cause oxidation of the activated carbon move away from the activated carbon towards the counter electrode immediately after they are formed, oxidation of the activated carbon is inhibited.

In addition, hydrogen halide formed by the reaction is present in the solution, and this hydrogen halide can be later decomposed to hydrogen and halogen by electrical decomposition or thermal decomposition.

Activated carbon electrodes having a structure like that shown in FIG. 1 can be used. Namely, metal mesh 13 made of copper, silver, nickel, etc. is sandwiched between carbon plastic sheets 12 having a thickness of 0.5–2 mm, after which activated carbon cloth 11 is hot-pressed onto the surface to form an activated carbon electrode. These carbon plastic sheets 12 are formed by kneading carbon black and polyethylene resin followed by extrusion molding. Electrode wire 14 made of a metal that is not corroded by halogen such as platinum or titanium is connected to metal mesh 13. As a result of employing this type of constitution, the same potential can be applied over the entire activated carbon electrode.

Although various types of metals can be used for the counter electrode, in order to allow the electrode reaction of $$O^- \rightarrow \tfrac{1}{2}O_2+e^-$$

to take place on its surface, a metal having a low oxygen overvoltage is preferable because it results in higher efficiency. In addition, it is also necessary that the metal be resistant to corrosion by halogens since it is inserted into a halogen aqueous solution. Thus, preferable examples of counter electrodes include those made of noble metals such as platinum, ruthenium, rhodium, palladium and iridium as well as their oxides.

Contact between the activated carbon electrode and counter electrode should be in the form of physical contact in order to allow ions to move to the counter electrode as described above. For example, contact may be only made by the activated carbon fibers. In addition, although the activated carbon electrode and counter electrode may be in contact over their entire surfaces, it is preferable that the activated carbon electrode and counter electrode be separated to a certain extent and only allowed to make partial contact in order to allow ions that oxidize the activated carbon to separate from the activated carbon, to allow the oxygen that is produced to be released, and to allow the halogen solution and activated carbon to make contact.

As described above, a natural potential is generated between the electrodes as a result of connecting the activated carbon electrode and counter electrode. Although oxygen is produced at the counter electrode, by additionally applying a potential between both electrodes, the reaction rate is improved by the flow of electrons, thereby increasing the amount of oxygen produced and inhibiting oxidation of the activated carbon. This is because the application of an electric potential increases the rate at which oxygen ions are reduced at the anode in the form of the counter electrode.

In the above-mentioned constitution, although the activated carbon electrode and counter electrode are in direct contact when brought into direct contact in this manner, a short may occur resulting in poor efficiency particularly in the case of applying an electric potential between the electrodes. In addition, although it is preferable that the activated carbon electrode and counter electrode make only partial contact and do not make contact over their entire surfaces, in this case, poor efficiency also results since ion movement only takes place at the location of that partial contact. Therefore, an anion electrolyte membrane, which allows the movement of oxygen ions between the activated carbon electrode and counter electrode is positioned between the electrodes, and contact is made between the activated carbon electrode and counter electrode through this anion electrolyte membrane. Examples of this anion electrolyte membrane include a solid polymer membrane like Seremion made by Asahi Glass and a ceramic electrolyte containing Ittria made by Nikkado. As a result of employing this type of constitution, oxygen ions generated on the surface of the activated carbon electrode move within the anion electrolyte and reach the counter electrode. Since that movement takes place over the entire surface of the anion electrolyte membrane, it is efficient and activated carbon oxidation inhibitory effects can be enhanced.

In this case as well, the contact between the activated carbon electrode and electrolyte film is not over their entire surfaces for contact between the halogen solution and activated charcoal, but rather, for example, it is preferable to provide projections on the surface of the electrolyte membrane to allow partial contact at these projections. In addition, in order to allow release of oxygen gas generated at the counter electrode, contact between the counter electrode and the electrolyte membrane is also preferably in the form of partial contact and not in the form of contact over their entire surfaces. Even if the contact among the activated carbon electrode, electrolyte membrane and counter electrode is in the form of, for example, partial contact, since the activated carbon electrode and counter electrode are not allowed to make direct contact, there is no occurrence of shorts between the electrodes thereby making it possible to improve the electrical efficiency.

Ions move more readily on the surface rather than inside the above-mentioned anion electrolyte. Therefore, by providing an opening in the anion electrolyte membrane that connects the activated carbon electrode and counter electrode and, more specifically, by opening up numerous holes in the electrolyte membrane, numerous surfaces are provided on which ions move easily. As a result, the rate of ion movement is increased thereby making it possible to increase the reaction rate.

By allowing the activated carbon electrode and counter electrode to make contact by layering the electrodes in an alternating arrangement, the reaction can be carried out efficiently in a small space.

EXAMPLE 1

Figure 2:
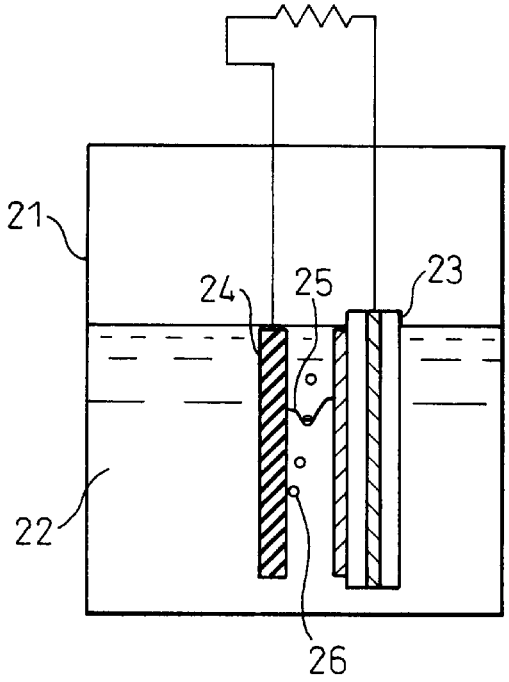
FIG. 2 is a sketch of the reaction system of the present invention in which an activated carbon electrode and counter electrode are in contact.

As shown in FIG. 2, bromine water 22 having a bromine concentration of 120 mM/liter was placed in a glass pressure-proof container 21 followed by the insertion of an activated carbon electrode 23 shown in FIG. 1 (amount of activated carbon: approx. 0.5 g), and a platinum electrode in the form of a counter electrode 24, into this container. The activated carbon electrode 23 and the counter electrode 24 were brought into contact with 1–2 activated carbon fibers 25, and the activated carbon electrode and counter electrode were connected outside the bromine water to constitute a reaction system after replacing the air in container 21 with nitrogen. The reaction was carried out for 60 minutes at a temperature of 100° C. The natural potential difference between activated carbon electrode 23 and counter electrode 24 at 100° C. was approximately 120 mV, and the natural potential of the activated carbon electrode was lower. Gas 26 generated during the course of this reaction was captured followed by analysis of the generated amounts of carbon dioxide and oxygen. In addition, a similar reaction was carried out using ruthenium oxide and iridium oxide for the counter electrodes. Moreover, similar reactions were carried out for comparative purposes with respect to the case of using only an activated carbon electrode without using a counter electrode, and the case of using an activated carbon electrode and counter electrode (titanium electrode) but not allowing the two electrodes to make contact. These results are shown in Table 1.

TABLE 1

| Counter Electrode | Amounts of Carbon Dioxide (ml) | Amounts of Oxygen (ml) |
|---|---|---|
| Pt | 4.3 | 1.9 |
| $RuO_2$ | 4.9 | 2.1 |
| $IrO_2$ | 3.2 | 2.3 |
| None (Only Activated Carbon Electrode) | 7.0 | 0.8 |
| Not Allowing the Two Electrodes to Make Contact | 6.8 | 1.2 |

According to the results of Table 1, the case of using the reaction system of the present invention resulted in a smaller amount of generated $CO_2$ and a larger amount of generated $O_2$ than the case of using activated carbon only and the case of not allowing the activated carbon electrode and counter electrode to make contact, thereby clearly indicating a high degree of activated carbon oxidation inhibitory effects. In addition, the HBr concentration following the reaction, in the case of using a platinum electrode for the counter electrode, was approximately 80 mM/liter.

EXAMPLE 2

Figure 3:
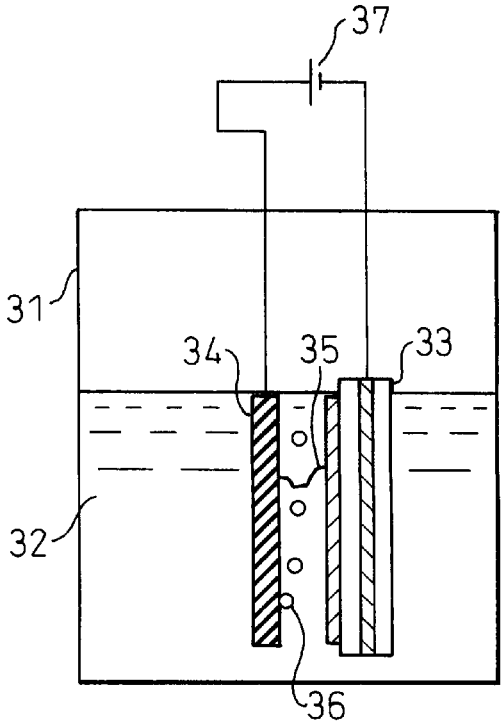
FIG. 3 is a sketch of the reaction system of the present invention in which an activated carbon electrode and counter electrode are in contact and a voltage is applied.

A reaction was carried out in the same manner as Example 1 with the exception of applying a voltage between the activated carbon electrode and counter electrode. Namely, as shown in FIG. 3, bromine water 32 having a bromine concentration of 120 mM/liter was placed in a glass pressure-proof container 31 followed by the insertion of an activated carbon electrode 33 shown in FIG. 1 (amount of activated carbon: approx. 0.5 g) and a platinum electrode in the form of a counter electrode 34 into this container. Activated carbon electrode 33 and counter electrode 34 were brought into contact with 1–2 activated carbon fibers 35, and the activated carbon electrode and counter electrode were connected outside the bromine water. Moreover, power supply 37 was also placed outside the bromine water to constitute a reaction system after replacing the air in container 31 with nitrogen. The natural potential difference between activated carbon electrode 33 and counter electrode 34 at 100° C. before applying a voltage was approximately 120 mV, and the natural potential of the activated carbon electrode was lower. Moreover, a voltage was applied to bring the potential difference between the electrodes to 500 mV (thus, a voltage of 380 mV was actually applied from the power supply) after which the reaction was carried out for 40 minutes at a temperature of 100° C. Gas 36 generated during the course of this reaction was captured followed by analysis of the generated amounts of carbon dioxide and oxygen. In addition, a similar reaction was carried out using ruthenium oxide and iridium oxide for the counter electrodes. Those results are shown in Table 2.

TABLE 2

| Counter Electrode | Amounts of Carbon Dioxide (ml) | Amounts of Oxygen (ml) |
|---|---|---|
| Pt | 3.2 | 5.1 |
| $RuO_2$ | 4.0 | 4.1 |
| $IrO_2$ | 2.8 | 6.1 |

When the results of Table 2 were compared with the results of Table 1, application of a voltage clearly resulted in an improvement in activated carbon oxidation inhibitory effects and reaction efficiency due to a decrease in the amount of $CO_2$ generated and an increase in the amount of $O_2$ generated. In addition, the HBr concentration following the reaction in the case of using a platinum electrode for the counter electrode was approximately 100 mM/liter. This result also clearly indicates that the reaction rate had improved.

EXAMPLE 3

A reaction was carried out in nearly the same manner as Example 2 with the exception of using iodine instead of bromine. Namely, the reaction was carried out for 60 minutes at 180° C. in a similar reaction system after adding 90 ml of water and 5 g of iodine to the pressure-proof container instead of bromine water. In addition, the potential difference between the activated carbon electrode and counter electrode was 500 mV, and potential on the activated carbon electrode side was lower. These results are shown in Table 3.

TABLE 3

| Counter Electrode | Amounts of Carbon Dioxide (ml) | Amounts of Oxygen (ml) |
|---|---|---|
| Pt | 4.1 | 1.7 |
| $RuO_2$ | 3.9 | 2.1 |
| $IrO_2$ | 2.9 | 3.1 |
| None | 6.0 | 1.3 |

According to the results of Table 3, activated carbon oxidation inhibitory effects were observed in the case of using iodine as well. The concentration of HI formed after this reaction was approximately 90 mM/liter.

EXAMPLE 4

Figure 4:
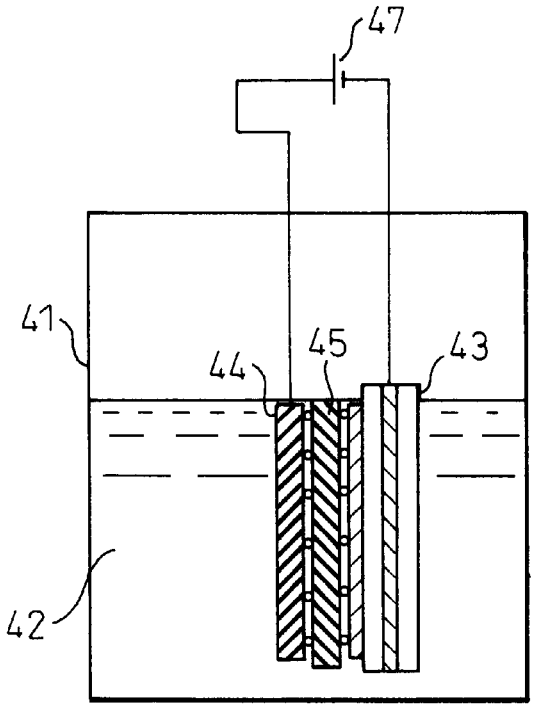
FIG. 4 is a sketch of the reaction system of the present invention in which an activated carbon electrode and counter electrode are in contact through an anion electrolyte membrane.

A reaction was carried out in the same manner as Example 2 with the exception of arranging an anion electrolyte membrane between the activated carbon electrode and counter electrode. Namely, as shown in FIG. 4, bromine water 42 having a bromine concentration of 120 mM/liter was placed in a glass pressure-proof container 41. A solid polymer membrane 45 was sandwiched between activated carbon electrode 43 (amount of activated carbon: approx. 0.5 g) shown in FIG. 1 and counter electrode 44 in the form of a platinum electrode, all of which were then inserted into the bromine water in the container. Small projections were provided in the form of dots over the surface of this solid polymer membrane to facilitate the release of gas generated as bromine water is supplied to vicinity of the electrodes. Furthermore, the metal portions of the electrodes and pressure-proof container were insulated with Teflon. The activated charcoal electrode and counter electrode were connected outside the bromine water and power supply 47 was placed outside the bromine water to constitute a reaction system after replacing the air in container 41 with nitrogen. The potential difference between the electrodes was set at 500 mV by applying a voltage, and the reaction was carried out for 40 minutes at a temperature of 100° C. Gas generated during the course of this reaction was captured followed by analysis of the generated amounts of carbon dioxide and oxygen. In addition, a similar reaction was carried out using ruthenium oxide and iridium oxide for the counter electrodes. These results are shown in Table 4.

TABLE 4

| Counter Electrode | Amounts of Carbon Dioxide (ml) | Amounts of Oxygen (ml) |
|---|---|---|
| Pt | 1.4 | 8.0 |
| $RuO_2$ | 2.2 | 7.1 |
| $IrO_2$ | 1.0 | 9.5 |

In comparison with the results shown in Table 2, the placement of an anion electrolyte membrane between the electrodes resulted in greater inhibition of oxidation of the activated carbon electrode, while also increasing the amount of oxygen generated. In addition, the concentration of HBr after the reaction was approximately 120 mM/liter, which also indicates an improvement in the reaction rate.

EXAMPLE 5

A reaction was carried out similar to that of Example 4 with the exception of providing a plurality of circular holes in the solid polymer membrane 45 in the electrode configuration shown in FIG. 4. The amounts of $CO_2$ and $O_2$ formed are shown in Table 5.

TABLE 5

| Counter Electrode | Amounts of Carbon Dioxide (ml) | Amounts of Oxygen (ml) |
|---|---|---|
| Pt | 1.3 | 9.1 |
| $RuO_2$ | 2.1 | 8.1 |
| $IrO_2$ | 0.9 | 10.5 |

In comparison with the results shown in Table 4, the providing of openings in an anion electrolyte membrane further inhibited oxidation of the activated carbon electrode, while also increasing the amount of oxygen generated. In addition, the concentration of HBr after the reaction was approximately 130 mM/liter, which also indicates that the reaction rate was improved.

EXAMPLE 6

Figure 5:
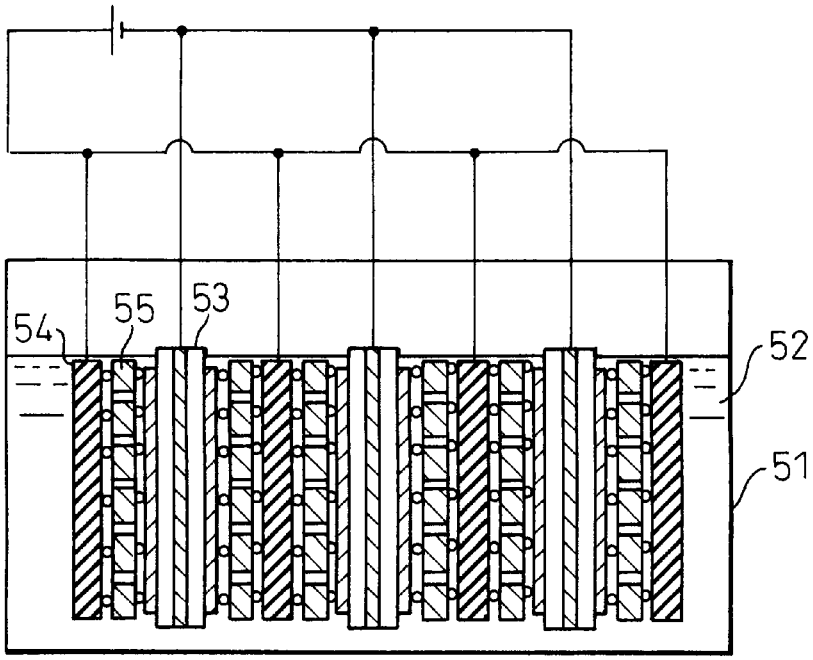
FIG. 5 is a sketch of the reaction system of the present invention in which an activated carbon electrode and counter electrode are in contact in alternating multiple layers.

A reaction was carried out similar to that of Example 5 with the exception of repeatedly using a plurality of combinations of the electrodes used in Example 5. Namely, as shown in FIG. 5, bromine water 52 having a bromine concentration of 120 mM/liter was placed in glass pressure-proof container 51. Solid polymer membrane 55, provided with openings between the electrodes, was sandwiched between activated carbon electrode 53, press fitted with activated carbon cloth, on both sides, and a counter electrode 54 in the form of a platinum electrode, and a plurality of these combinations of electrodes were layered and inserted into the bromine water in the container. The activated charcoal electrodes were connected in series and the counter electrodes were connected in series outside the bromine water and the reaction was carried out while applying a voltage. As a result of employing this constitution, the reaction was able to be carried out efficiently in a small space.

According to the present invention, by using activated carbon serving as a catalyst for an electrode and bringing this activated carbon electrode in contact with a counter electrode in a method of reacting water and halogen, oxidation of the activated carbon, namely generation of carbon dioxide, can be inhibited even at high temperatures, thereby making it possible to improve reaction efficiency.

What is claimed is:

1. A method of producing hydrogen halide and oxygen by reacting water and halogen as represented with the following formula:

$$H_2O+X_2 \rightarrow HX+\tfrac{1}{2}O_2 \quad (1)$$

wherein X represents a halogen, wherein activated carbon is used as catalyst, said activated carbon is inserted into an aqueous solution containing said halogen as an electrode, a counter electrode is inserted into said solution and, after bringing this counter electrode into contact with said active carbon electrode, the above reaction takes place in a reaction system in which said activated carbon electrode and counter electrode are connected outside said aqueous solution.

2. The method as set forth in claim 1 wherein a voltage is applied to said activated carbon electrode and counter electrode.

3. The method as set forth in either of claims 1 or 2 wherein said activated carbon electrode and counter electrode are in contact through an anion electrolyte membrane.

4. A method as set forth in claim 3 wherein an opening is provided in said anion electrolyte membrane that connects said activated carbon electrode and counter electrode.

5. A method as set forth in claim 1 wherein said activated carbon electrode and counter electrode are in contact in alternating multiple layers.

6. A method as set forth in claim 1 wherein said counter electrode is made of platinum, ruthenium, rhodium, palladium, iridium or their oxides.

* * * * *